US011134811B2

(12) United States Patent
Formon et al.

(10) Patent No.: US 11,134,811 B2
(45) Date of Patent: Oct. 5, 2021

(54) WEB MATERIAL ROLL DISPENSER AND ROLL SUPPORT ASSEMBLY FOR A WEB MATERIAL ROLL DISPENSER

(71) Applicant: CASCADES CANADA ULC, Montreal (CA)

(72) Inventors: John Formon, Forsyth, GA (US); Matthew T. Woerpel, Lodi, WI (US); Jeffrey J. Brickl, Prairie Du Sac, WI (US); Edward A. Raleigh, Lodi, WI (US)

(73) Assignee: CASCADES CANADA ULC, Montreal (CA)

( * ) Notice: Subject to any disclaimer, the term of this patent is extended or adjusted under 35 U.S.C. 154(b) by 270 days.

(21) Appl. No.: 16/296,938

(22) Filed: Mar. 8, 2019

(65) Prior Publication Data

US 2019/0274492 A1 Sep. 12, 2019

Related U.S. Application Data

(60) Provisional application No. 62/640,602, filed on Mar. 9, 2018.

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01); *A47K 2010/3863* (2013.01)

(58) Field of Classification Search
CPC ..... A47K 10/38; A47K 10/3836; A47K 2010/3863; A47K 2010/3253
See application file for complete search history.

(56) References Cited

U.S. PATENT DOCUMENTS 2,905,404 A 9/1959 Simmons
4,660,781 A 4/1987 Hazard
(Continued)

FOREIGN PATENT DOCUMENTS

CA 2605411 C 6/2013
WO WO-2016032627 A1 3/2016
(Continued)

*Primary Examiner* — Sang K Kim
*Assistant Examiner* — Nathaniel L Adams
(74) *Attorney, Agent, or Firm* — Marshall, Gerstein & Borun LLP

(57) ABSTRACT

A roll support assembly for a web material dispenser configured to contain a roll of web material having a first interior end. The roll support assembly includes a roll support mountable into the web material dispenser and including a roll-engaging portion with a peripheral wall engageable into the first interior end of the roll of web material with the roll of web material being rotatable relative to the roll support when engaged therewith and when a pulling force is exerted on the web material; and a rotation brake comprising at least one braking protrusion protruding outwardly from the peripheral wall of the roll-engaging portion and decelerating the rotation of the roll of web material by frictionally engaging at least one of directly and indirectly the roll of web material. The disclosure also concerns a web material roll dispenser with such a roll support assembly.

39 Claims, 12 Drawing Sheets

(56) References Cited

U.S. PATENT DOCUMENTS

| | | | | |
|---|---|---|---|---|
| 5,170,956 | A * | 12/1992 | McTaggart ..... | A47K 10/3836 242/422.4 |
| 5,249,755 | A | 10/1993 | Jespersen | |
| 5,868,343 | A | 2/1999 | Granger | |
| 5,988,561 | A | 11/1999 | Mele | |
| 6,092,758 | A | 7/2000 | Gemmell | |
| 6,416,011 | B2 | 7/2002 | Granger | |
| 6,793,097 | B2 | 9/2004 | Kamenstein | |
| 7,104,418 | B2 | 9/2006 | Kamenstein | |
| 7,290,733 | B2 | 11/2007 | Kamenstein et al. | |
| 7,500,420 | B2 | 3/2009 | Cvjetkovic et al. | |
| 9,730,560 | B2 | 8/2017 | Flocchini | |
| 9,770,142 | B2 | 9/2017 | Ochoa, Sr. et al. | |
| 9,795,258 | B2 | 10/2017 | Keily et al. | |
| 2015/0374181 | A1 | 12/2015 | Morand | |
| 2016/0157682 | A1 | 6/2016 | Keily et al. | |
| 2016/0242603 | A1 | 8/2016 | Cvjetkovic | |

FOREIGN PATENT DOCUMENTS

| | | | |
|---|---|---|---|
| WO | WO-2016089508 | A1 | 6/2016 |
| WO | WO-2016089589 | A1 | 6/2016 |
| WO | WO-2016137676 | A1 | 9/2016 |

* cited by examiner

WEB MATERIAL ROLL DISPENSER AND ROLL SUPPORT ASSEMBLY FOR A WEB MATERIAL ROLL DISPENSER

PRIOR APPLICATION

The present application claims the benefit of the filing date of U.S. provisional patent application No. 62/640,602, filed on Mar. 9, 2018, and entitled "WEB MATERIAL ROLL DISPENSER AND ROLL SUPPORT ASSEMBLY FOR A WEB MATERIAL ROLL DISPENSER", the disclosure of which being hereby incorporated by reference in its entirety.

TECHNICAL FIELD OF THE INVENTION

The present disclosure generally relates to a roll support assembly for a web material roll dispenser and to a web material roll dispenser, wherein the web material can include, for example, a roll of tissue paper such as and without being limitative paper towel, and more particularly to a roll support assembly that is configured to limit an excessive unwinding of the roll of web material.

BACKGROUND

Several types of paper roll dispensers exist in the prior art, that are configured to support a paper roll comprising a roll of tissue paper. Paper roll dispensers typically include, amongst others, a housing (or enclosure) defining an interior chamber and a roll support assembly located within the interior chamber of the housing and configured to rotatably receive and support the paper roll.

A free end (or tail) of the roll of tissue paper usually protrudes out of the housing so that the free end can be grasped by a user. When a pulling force is exerted by the user on the tissue paper via its free end or tail, the paper roll rotates about the roll support assembly to deliver a portion of the tissue paper to the user.

However, when the pulling force is excessive relative to the required force to rotate the paper roll about the roll support assembly, it may happen that an excessive length of tissue paper is unwound with respect to the length supplied to the user. This excessive length of tissue paper might form an accumulation of paper inside the interior chamber of the paper roll dispenser, and thus hinder the working of the paper roll dispenser. This excessive rotation of the paper roll about the roll support assembly is sometimes referred to as overspinning.

It is further appreciated that the required force to rotate the paper roll about the roll support assembly varies in accordance with the weight of the paper roll. Full paper rolls require a higher force to be engaged in rotation in comparison with almost-empty paper rolls. Furthermore, due to their weight, full paper rolls typically end their revolutions faster than almost-empty ones.

In view of the above, there is a need for a web material roll dispenser and for a roll support assembly to be mounted in a web material roll dispenser which would be able to at least minimize some of the above-discussed prior art concerns.

BRIEF SUMMARY OF THE INVENTION

It is therefore an aim of the present invention to address the above-mentioned issues.

According to a general aspect, there is provided a roll support assembly for a web material dispenser configured to contain a roll of web material having a first interior end, the roll support assembly comprising a roll support mountable into the web material dispenser and including a roll-engaging portion with a peripheral wall engageable into the first interior end of the roll of web material with the roll of web material being rotatable relative to the roll support when engaged therewith and when a pulling force is exerted on the web material; and a rotation brake comprising at least one braking protrusion protruding outwardly from the peripheral wall of the roll-engaging portion and decelerating the rotation of the roll of web material by frictionally engaging at least one of directly and indirectly the roll of web material.

According to another aspect, there is provided a roll support assembly for a web material roll dispenser having a housing and configured to contain a roll of web material having a first interior end, the roll support assembly comprising a roll support mountable to the housing of the web material roll dispenser and engageable with the first interior end of the roll of web material with the roll of web material being rotatable relative to the roll support when engaged therewith and when a pulling force is exerted on the web material, the roll support having a center and an outer surface extending peripherally from the center of the roll support, and a rotation brake connected to the roll support and having at least one braking protrusion protruding outwardly from the outer surface of the roll support, the roll of web material frictionally engaging the at least one braking protrusion when a center of the roll of web material is substantially horizontally offset with respect to the center of the roll support due to a high rotation speed of the roll of web material relative to the roll support.

According to another aspect, there is provided a roll support assembly for a web material dispenser having a dispensing opening and configured to contain a roll of web material having a first interior end and dispense the web material through the dispensing opening. The roll support assembly comprises a roll support mountable into the web material dispenser and having a substantially cylindrical body with a peripheral wall and a roll-engaging portion engageable with the first interior end of the roll of web material with the roll of web material being rotatable relative to the roll support when engaged with the roll-engaging portion and when a pulling force is exerted on the web material, the roll of web material being configurable in a normal configuration and an overspinning configuration with respect to the roll-engaging portion of the roll support wherein, in the overspinning configuration, the roll of web material is displaced towards the dispensing opening due to a high rotation speed of the roll of web material relative to the roll-engaging portion of the roll support. The roll support assembly further comprises at least one braking protrusion protruding outwardly from the peripheral wall of the cylindrical body in the roll-engaging portion, the at least one braking protrusion being spaced-apart from the roll of web material in the normal configuration and the roll of web material frictionally engaging the at least one braking protrusion in the overspinning configuration.

According to another aspect, there is provided a roll support assembly for a web material roll dispenser having a housing and configured to support a roll of web material having a first interior end, the web material roll dispenser having a dispensing opening, the roll support assembly comprising a roll support mountable to the housing of the web material roll dispenser and engageable with the first interior end of the roll of web material with the roll of web material being rotatable relative to the roll support when engaged therewith and when a pulling force is exerted on the web material, the roll support including a substantially cylindrical body with an outer surface. The roll support further includes at least one braking protrusion protruding outwardly from the outer surface of the cylindrical body, the roll of web material roll frictionally engaging the at least one braking protrusion when the roll of web material is displaced towards the dispensing opening due to a high rotation speed of the roll of web material relative to the roll support.

According to another aspect, there is provided a roll support assembly configured to be mounted in a housing of a web material roll dispenser and to rotatably receive and support a roll of web material having a first interior end, the roll support assembly comprising a roll support arm configured to be mounted to the housing, and a fixed roll support extending from the roll support arm and being at least partially engageable in the first interior end of the roll of web material with the roll of web material being rotatable relative to the fixed roll support when engaged therewith and when a pulling force is exerted on the web material, the roll support comprising a cylindrical body with a peripheral wall defining an outer surface and at least one braking protrusion protruding outwardly from the outer surface of the cylindrical body, the roll of web material frictionally engaging the at least one braking protrusion when a rotation speed of the roll of web material relative to the fixed roll support exceeds or is equal to a first threshold, the roll of web material being free from any engagement with said at least one braking protrusion when the rotation speed of the roll of web material relative to the fixed roll support is less than said first threshold.

According to another aspect, there is provided a roll support assembly configured to be mounted in a housing of a web material roll dispenser and to rotatably receive and support a roll of web material having a first interior end, the roll support assembly comprising a roll support arm configured to be mounted to the housing, and a fixed roll support extending from the roll support arm and being at least partially engageable with the first interior end of the roll web material with the roll of web material being rotatable relative to the fixed roll support when engaged therewith and when a pulling force is exerted on the web material, the fixed roll support comprising a cylindrical body having a peripheral wall and at least one braking protrusion protruding outwardly from the peripheral wall of the cylindrical body, the roll of web material frictionally engaging the at least one braking protrusion when a center of the roll of web material is substantially horizontally offset with respect to a center of the fixed roll support due to the pulling force exerted on the web material.

According to another aspect, there is provided a web material dispenser comprising a housing; and a roll support assembly according to the present disclosure, the roll support assembly being located within the housing and mounted thereto.

According to another aspect, there is provided a web material roll dispenser configured to support a roll of web material having a first interior end, the web material roll dispenser comprising a housing, a roll support assembly located within the housing configured to rotatably receive and support the roll of web material, the roll support assembly including a fixed roll support having at least one braking protrusion, the fixed roll support being at least partially engageable inside the first interior end of the roll of web material with the roll of web material being rotatable relative to the fixed roll support when engaged therewith and when a pulling force is exerted on the web material, the roll of web material frictionally engaging the at least one braking protrusion when the roll of web material is substantially horizontally displaced with respect to the fixed roll support due to a high rotation speed of the roll of web material relative to the fixed roll support.

According to another aspect, there is provided a web material dispenser configured to support a roll of web material having a first interior end, the web material dispenser comprising a housing defining a dispensing opening; and a roll support assembly located within the housing and configured to rotatably receive and support the roll of web material. The roll support assembly includes a roll support mounted to the housing and including a substantially cylindrical body having a peripheral wall, a lower half and a vertical central axis, the cylindrical body being engageable with the first interior end of the roll of web material with the roll of web material being rotatable relative to the cylindrical body when engaged therewith; and at least one braking protrusion protruding from the peripheral wall of the cylindrical body in the lower half thereof, offset from the vertical central axis of the cylindrical body. The roll of web material frictionally engages the at least one braking protrusion when a center of the roll of web material is substantially horizontally offset with respect to a center of the roll support due to an excessive pulling force exerted on the web material and disengaged from the at least one braking protrusion otherwise.

DETAILED DESCRIPTION

Figure 1:
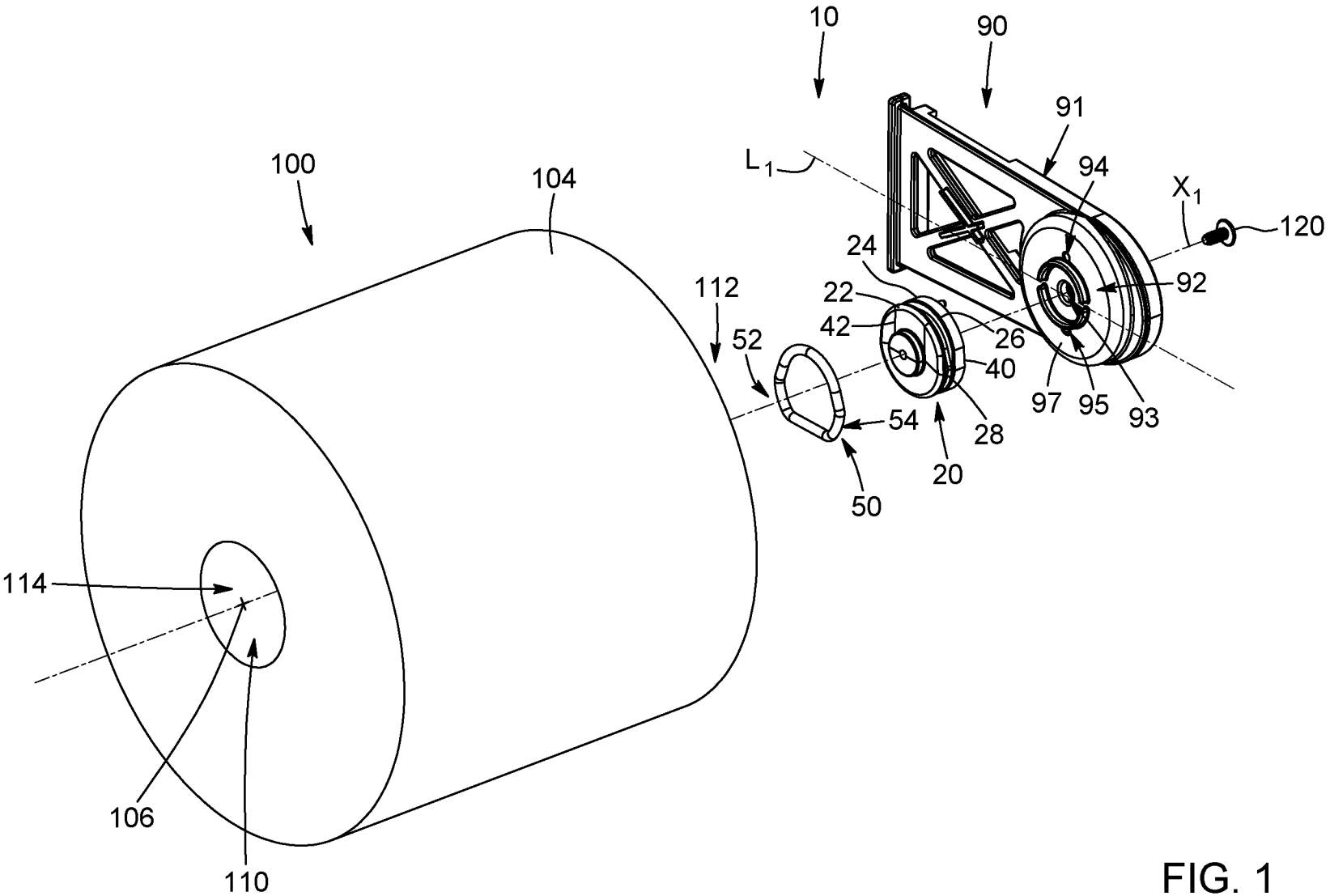
FIG. 1 is a perspective view, exploded, of a first embodiment of a portion of a roll support assembly including a roll support and a roll of web material.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of a roll support assembly and corresponding parts when mounted in a web material roll dispenser, with the "front" corresponding to a position closer to the user and to a dispensing opening of the web material roll dispenser and the "rear" corresponding to a position closer to a support to which the web material roll dispenser is mounted. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

In the above description, an embodiment is an example or implementation. The various appearances of "one embodiment," "an embodiment" or "some embodiments" do not necessarily all refer to the same embodiments.

Although various features may be described in the context of a single embodiment, the features may also be provided separately or in any suitable combination. Conversely, although the invention may be described herein in the context of separate embodiments for clarity, it may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only.

The principles and uses of the teachings of the present disclosure may be better understood with reference to the accompanying description, figures and examples.

It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above.

It is to be understood that the terms "including", "comprising", and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present disclosure may be implemented in the testing or practice with methods and materials equivalent or similar to those described herein.

Figure 2A:
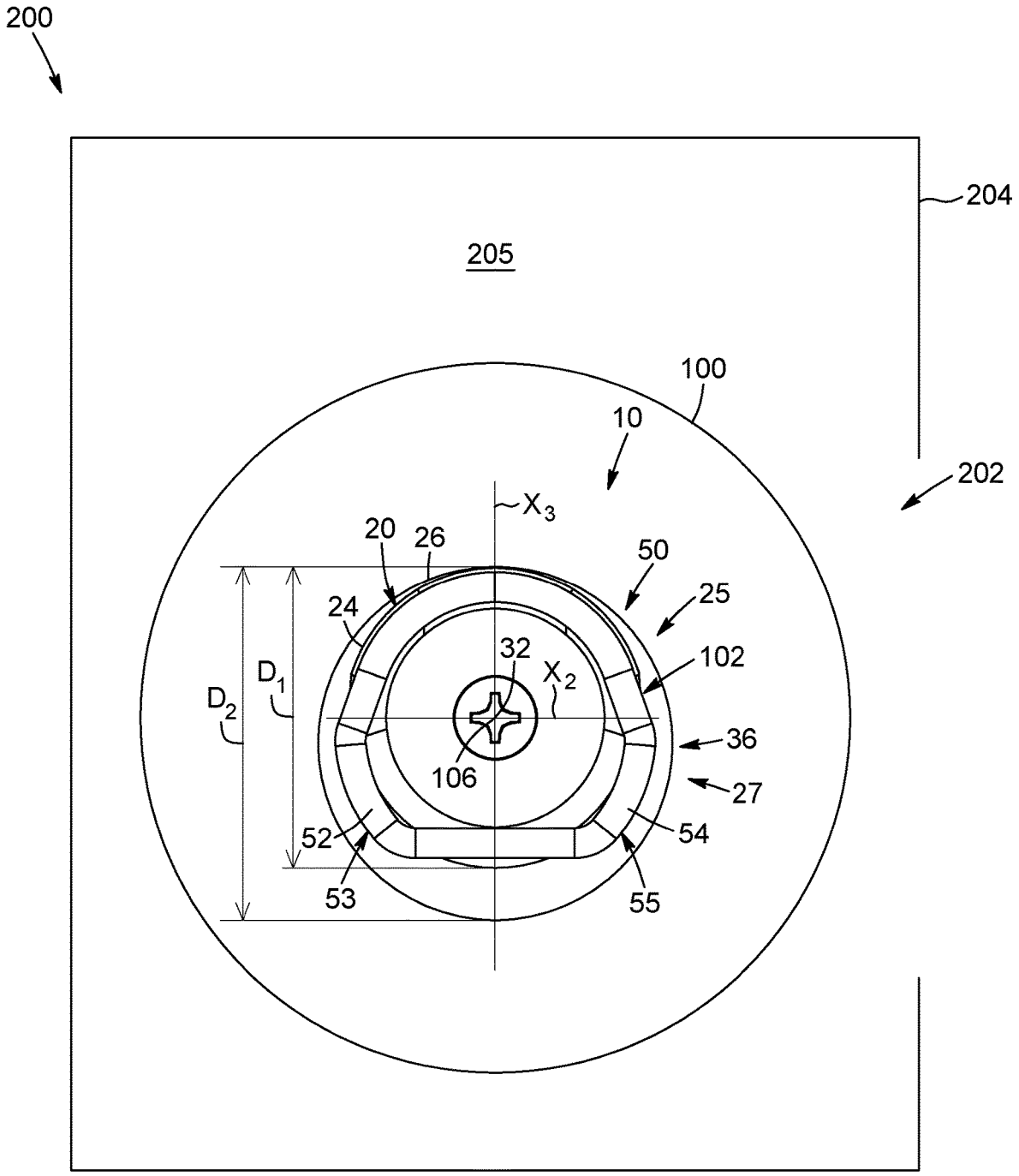
FIGS. 2A and 2B are side elevation views of the roll support of the portion of the roll support assembly of FIG. 1 engaged with the roll of web material, the roll of web material being supported in a housing of a web material roll dispenser, the roll support assembly being respectively configured in a normal configuration and in an overspinning configuration.
Figure 2B:
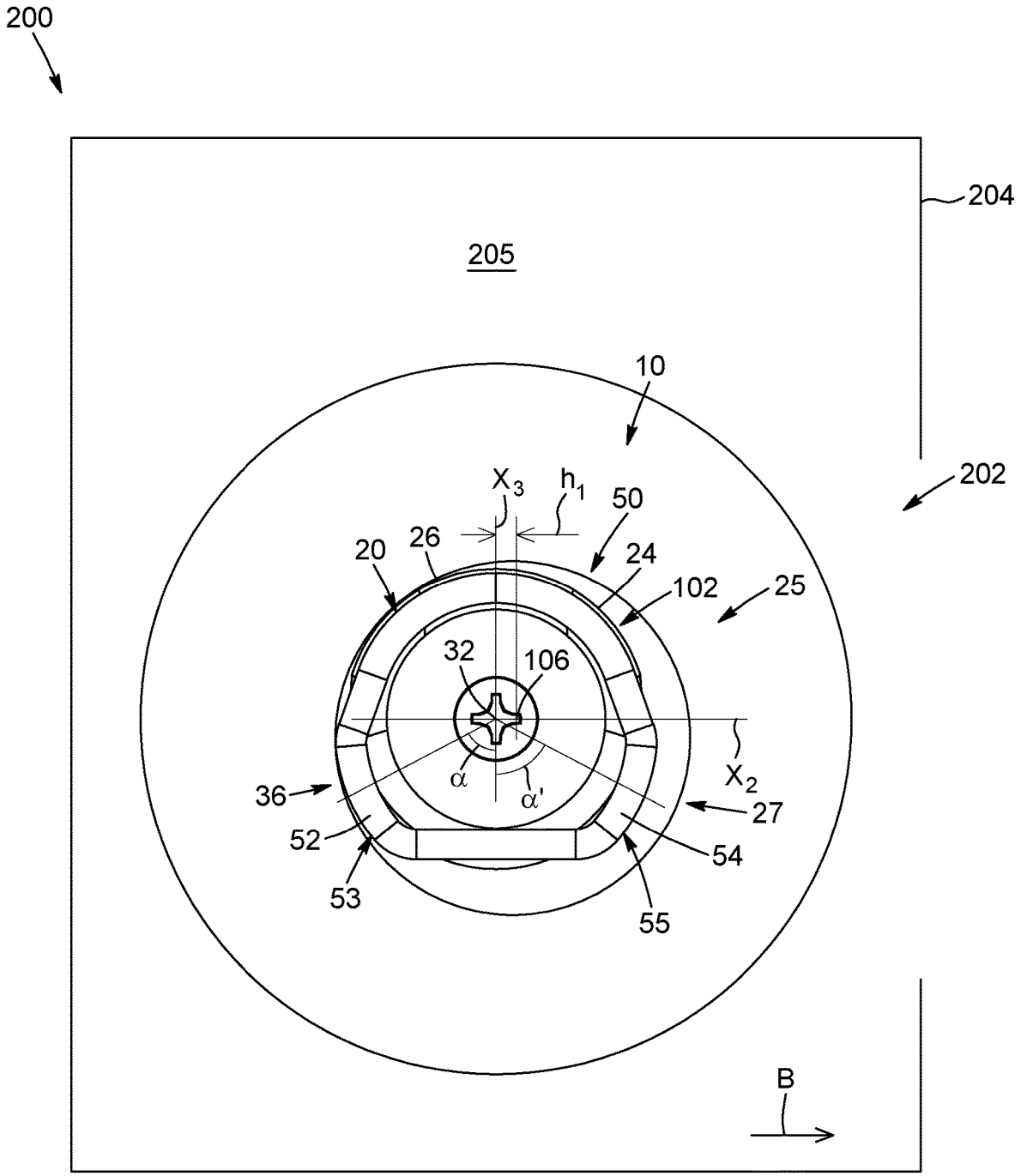

Referring now to the drawings, and more particularly to FIGS. 1, 2A and 2B, there is shown a first embodiment of a portion of a roll support assembly 10 that is part of a web material roll dispenser 200, such as a dispenser for a paper tissue roll including a paper towel roll. The roll support assembly 10 is configured to support a roll 100 of web material 104 defining a central passageway 110 and opposed first and second roll ends 112, 114. In the present description, the engagement between the roll support assembly 10 and the first roll end 112 will be described. However, it is appreciated that the roll support assembly 10 is selectively engageable with both first and second roll ends 112, 114. More particularly, as will be described in more details below, the roll support assembly 10 is engageable with an interior portion of the roll 100 defining the central passageway 110, adjacent to the first roll end 112, which will be referred to as an interior end 102 and, more particularly, as a first interior end 102 in reference to the first one of the first and second roll ends 112, 114.

In an embodiment (not shown), a central core (not shown) might extend at least partially in the central passageway 110 of the roll 100 of web material. For instance, the central core can be made of cardboard and the web material 104 is rolled around the central core. Even though the central core might be useful to help and maintain the shape and dimensions of the central passageway of the roll 100 of web material, it could be conceived a roll 100 of web material—as represented in FIGS. 1, 2A and 2B—in which no central core extends in the central passageway 110. Such rolls of web material are sometimes referred to as "coreless" rolls.

Typically, the web material roll 100 is physically supported at both first and second roll ends 112, 114, but the roll support assembly 10 will be described hereinbelow in reference with only one of the first and second roll ends 112, 114. Thus, only a portion of the roll support assembly 10, associated with one of the first and second roll ends 112, 114 (with the first roll end 112, in the embodiment shown), will be described. It is appreciated that the other portion of the roll support assembly 10, associated with the other one of the first and second roll ends 112, 114, can be either similar, identical or different from the embodiments of the portion of the roll support assembly 10 described hereinafter.

Figure 10:
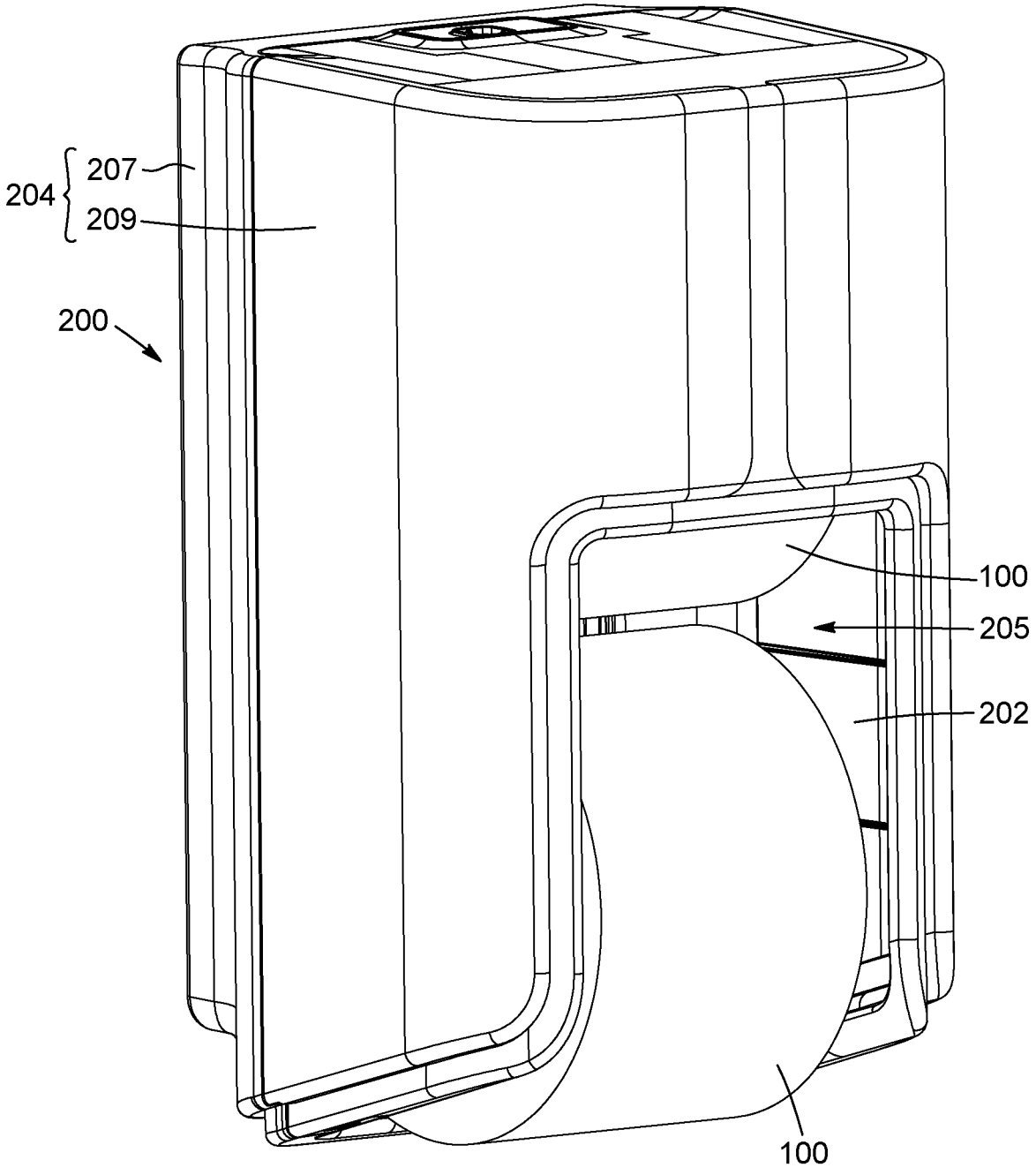
FIG. 10 is a perspective view of a web material dispenser according to an embodiment, the dispenser comprising first and second rolls of web material supported in a housing of the web material dispenser by roll support assemblies according to the present disclosure.

As represented for instance in FIGS. 2A, 2B, 6A, 6B and 10, the web material roll dispenser 200 also includes a housing (or enclosure) 204 defining an interior chamber 205. The roll support assembly 10 is located within the interior chamber 205 of the housing 204. As represented in FIG. 10, the housing 204 is configured to house two rolls 100 of web material. In the embodiment shown, the housing 204 comprises a back-wall member 207 and a cover member 209. Moreover, a web material dispensing opening 202 (or dispensing opening 202) is formed in the housing 204 (in the cover member 209, in the embodiment shown), for a free end of the web material to be dispensed to a user therethrough. It is appreciated that the shape and the configuration of the web material roll dispenser 200, the location of the dispensing opening 202 and the number and location of the rolls of web material can vary from the embodiment shown.

The web material roll dispenser 200 also includes a material advancement or feed mechanism (not represented) that is configured to cause the roll dispenser to dispense an amount of web material (or tissue paper) for use by a user through the dispenser opening 202 (or mouth).

In the embodiment shown, the roll support assembly 10 firstly comprises a roll support arm 90 that is configured to be mounted to the housing 204 of the web material roll dispenser 200. In an embodiment, the roll support arm 90 can be secured to either the backwall member 207 or a side wall of the housing 204. In an alternative embodiment, it is appreciated that the roll support assembly 10 can be free of roll support arm 90 and the other components of the roll support assembly 10 can be mounted directly or indirectly to the housing 204 of the web material roll dispenser 204.

In the shown embodiment, as represented for instance in FIGS. 1, 3, 4 and 7, the roll support arm 90 includes a support arm body 91 which extends substantially horizontally along a longitudinal direction L1, extending between the back-wall member 207 and the cover 209 of the housing 204, when fixed to the housing of the web material roll dispenser.

The roll support arm 90 has a roll receiving end 92 in which an opening 93 and apertures 94, 95 are formed, the purpose of which will be described in more details below.

In the embodiment shown, the roll receiving end 92 includes a rounded protuberance, protruding inwardly from the support arm body 91, i.e. protruding towards the roll support arm of the other roll support assembly and in a spacing defined between both roll supporting arms 90 configured to receive the roll 100 of web material in between. It is appreciated that the shape and the configuration of the roll support arm 90, and of its support arm body 91 and its roll receiving end 92 can vary from the embodiment shown.

The roll support assembly 10 further comprises a roll support 20 that is mountable to the web material roll dispenser 200 via the roll support arm 90. In the shown embodiment, as represented in FIGS. 1, 3, 4 and 8, the roll support 20 comprises a substantially cylindrical body 34 having a center 32 and extending along a first axis X1. In the embodiment shown, the cylindrical body 34 is located at a free end of the roll support arm 90. The cylindrical body 34 of the roll support 20 defines a roll-engaging portion 22 and comprises a support-engaging face 40 that is configured to face and abut the roll support arm 90 when mounted thereto (and more particularly to face a roll support-engaging face 97 of the roll receiving end 92), and an opposed roll-engaging face 42. The roll support 20 is configured to be fixedly secured to the roll support arm 90, for instance with a mechanical fastener, such as and without being limitative a screw 120, as in the shown embodiment, inserted in both the roll support 20 and the roll support arm 90. In the embodiment shown, the mechanical fastener 120 is insertable in an opening formed in the center 32 of the roll support 20 and in an opening 93 formed substantially centrally in the roll receiving end 92, which are aligned when the roll support 20 is mounted to the roll support arm 90.

Once fixed thereto, the roll support 20 extends inwardly from the roll support arm 90, i.e. towards the opposite roll support arm 90 or the opposite sidewall of the web material roll disperser 200.

In an alternative embodiment (not shown), it is appreciated that the roll support 20 can be mounted directly to the housing of the web material roll dispenser, such as for instance to one of the sidewalls of the web material roll dispenser or to any other suitable structural component of the web material roll dispenser and protrude within the interior chamber of the housing to at least partially and rotatably support the web material roll therein.

When fixed to the roll support arm 90, to the housing of the web material roll dispenser or to any other suitable structural component of the web material roll dispenser, the roll support 20 is prevented from rotating thereabout. Therefore, the roll support 20 is fixedly mounted to the roll support arm 90, to the housing of the web material roll dispenser or to any other suitable structural component of the roll dispenser, and not rotatably mounted thereto.

In the embodiment shown, to further prevent rotation of the roll support 20 with respect to the supporting structure (either the roll support arm 90, the housing of the web material roll dispenser or to any other suitable structural component of the roll dispenser), the roll support 20 comprises anti-rotation pins 30, 41 (see FIGS. 4, 5, and 8) protruding from the support-engaging face 40 of the cylindrical body 34 of the roll support 20. The anti-rotation pins 30, 41 are dimensioned to be engaged in complementary apertures 94, 95 defined in the supporting structure, which is the roll receiving end 92 of the roll support arm 90 in the embodiment shown. It is thus understood that the engagement of the anti-rotation pins 30, 41 into the apertures 94, 95 prevents the roll support 20 from rotating relative to the supporting structure, such as the roll support arm 90 when mounted thereto. In other words, as mentioned above, the roll support 20 is fixedly mounted to the roll support arm 90. In other words, the roll-engaging portion 22 and the roll support arm 90 comprise complementary male-female members 30, 41, 94, 95 engageable together to prevent rotation of the roll-engaging portion 22 relative to the roll support arm 90 when engaged together.

Figure 5:
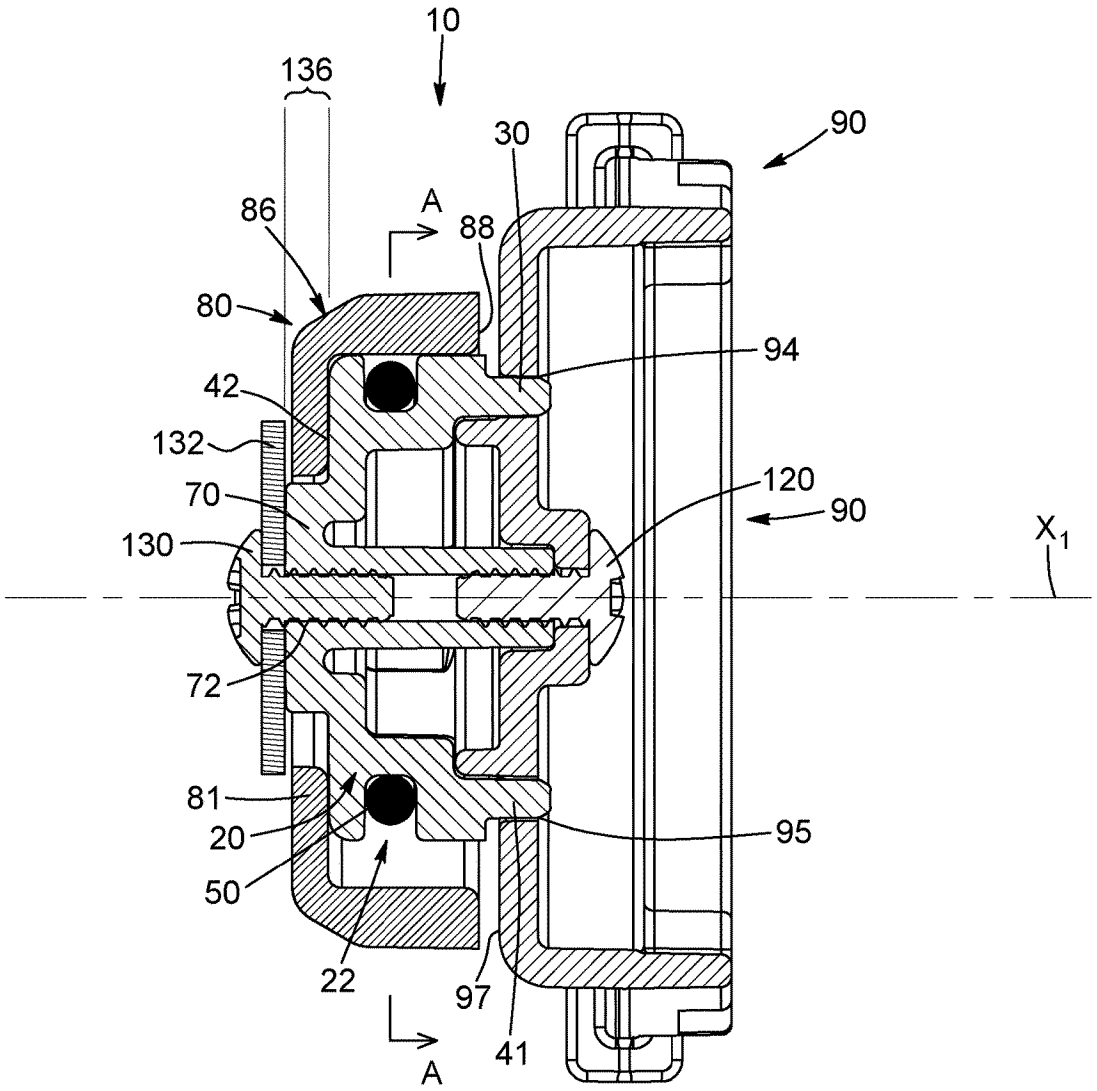
FIG. 5 is a cross sectional view of the portion of the roll support assembly of FIGS. 3 and 4, in a plane substantially parallel to a vertically-extending longitudinal axis of the roll support assembly.
Figure 8:
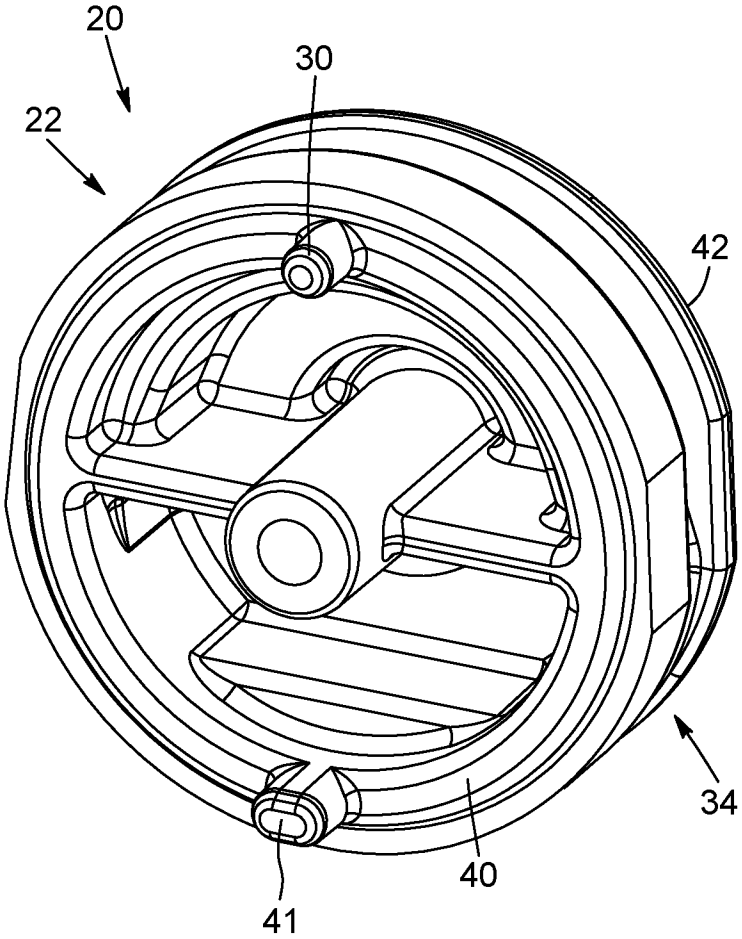
FIG. 8 is a rear perspective view of the roll support of the roll support assembly of FIGS. 3 and 4.

As represented in FIGS. 5 and 8, the anti-rotation pins 30, 41 are formed on either side of the center 32. Moreover, the anti-rotation pins 30, 41 can have a different shape from each other, as in the embodiment shown, to ensure a proper mounting of the roll support 20 to the roll support arm 90 (i.e. to ensure that the roll support 20 is mounted to the roll support arm 90 according to a predetermined direction). In the non-limitative embodiment shown, the anti-rotation pin 30 extending from an upper portion of the roll support 20 has a substantially circular cross-section, whereas the anti-rotation pin 41 extending from a lower portion of the roll support 20 has a substantially oblong cross-section. It is appreciated that the shape, the configuration, the location and the number of the anti-rotation pins 30, 41 of the roll support 20 and the matching openings (or apertures) 94, 95 of the roll support arm 90 can vary from the embodiment shown. Moreover, even though in the embodiment shown, male connecting members protrude from the support-engaging face 40 of the roll support 20 to be inserted into female connecting members formed in the roll support-engaging face 97 of the roll support arm 90, it could also be conceived a roll support assembly 10 having male connecting members (or engaging protrusions) protruding from the roll support-engaging face 97 of the roll support arm 90 and insertable into female connecting members formed in the support-engaging face 40 of the roll support 20.

It is appreciated that the roll support 20 can be mounted to and secured to the supporting structure by another securing assembly than the mechanical fastener 120. Furthermore, in an embodiment (not shown), the roll support 20 can be exempt of the anti-rotation pins 30, 41. Furthermore, the number, shape and arrangement of anti-rotation pins 30, 41 can vary from the embodiment shown.

The cylindrical body 34 of the roll support 20 comprises a peripheral outer surface 24 defined by a peripheral wall 26 of the roll support 20, extending between the support-engaging face 40 and the opposed roll-engaging face 42. In the embodiment shown, the roll-engaging portion 22 comprises a peripheral wall corresponding to the peripheral wall 26 of the cylindrical body 34. The cylindrical body 34 of the roll support 20 can be separated into an upper portion 25 and a lower portion 27; the upper and lower portions 25, 27 are defined with regard to the center 32 of the cylindrical body 34 of the roll support 20 (corresponding to a center of the roll-engaging portion 22 of the roll support 20) and to a substantially horizontal axis X2 passing through the center 32 (See FIGS. 2A and 2B). For instance and without being limitative, when the roll support 20 is mounted to the roll support arm 90, the upper and lower portions 25, 27 are defined with regard to the longitudinal direction L1 extending through the center 32.

The roll-engaging portion 22 of the roll support 20 is engageable with the roll 100 of web material, i.e. in the central passageway 110 and, more particularly, in the first interior end 102 of the roll 100 of web material. It is understood that, when the roll support 20 is fixedly secured to the web material roll dispenser 200, for instance via the roll support arm 90 as in the shown embodiment, the roll-engaging portion 22 forms a free end of the roll support 20.

As represented for instance on FIGS. 2A and 2B, the roll-engaging portion 22 of the roll support 20 has a first diameter D1, and the first interior end 102 of the web material roll 100 has a second diameter D2, the second diameter D2 being greater than the first diameter D1, so that the roll 100 of web material is rotatable about the roll support 20 when the roll-engaging portion 22 is engaged therewith and when a pulling force is exerted on the web material 104. In other words, the cooperation of the roll-engaging portion 22 of the roll support 20 with the first interior end 102 of the web material roll 100 ensures supply of web material when a pulling force is exerted on the web material 104, for instance when a user pulls on a tail—or free end—thereof.

It is appreciated that the shape and the configuration of the roll support 20 can vary from the embodiment shown.

The roll support assembly 10 further comprises a rotation brake 50. In the first shown embodiment, the rotation brake 50 is substantially an annular ring (for instance but without being limitative at least partially made of a polymeric material) and is mounted to the roll support 20, engaged with the peripheral outer surface 24 defined by the peripheral wall 26 of the cylindrical body 34, for instance by being received in a peripheral channel 28 that is defined in the peripheral wall 26 of the cylindrical body 34 of the roll support 20. It is appreciated that any other suitable mechanical fastener to engage the rotation brake 50 to the roll support 20 could be conceived. In the shown embodiment, the rotation brake 50 is fixedly secured to the peripheral wall 26 of the roll support 20, for instance by being glued thereto or due to the friction between the rotation brake 50 and the cylindrical body 34 of the roll support 20.

In the shown embodiment, the rotation brake 50 is generally annular in shape but also comprises first and second braking protrusions 52, 54 that are dimensioned to protrude outwardly from the peripheral wall 26 of the roll support 20 (i.e. to protrude outwardly from the peripheral wall 26 of the roll-engaging portion 22 defined by the cylindrical body 34). In the non-limitative embodiment shown, the first and second braking protrusions 52, 54 protrude outwardly from the peripheral wall 26 of the cylindrical body 34 of the roll support 20 when the rotation brake 50 is at least partially contained in the peripheral channel 28.

It is thus understood that the roll-engaging portion 22 of the roll support 20 and the rotation brake 50 are dimensioned and shaped so that they are insertable in the first interior end 102 of the roll of web material 100 without the braking protrusions 52, 54 of the rotation brake 50 contacting, in a normal configuration of the roll 100 of web material, an inner surface of the first interior end 102 of the roll of web material 100.

In the non-limitative embodiment shown, the first and second braking protrusions 52, 54 protrude from a lower portion 27 of the peripheral wall 26. In the shown embodiment, the first and second braking protrusions 52, 54 are symmetrically positioned in a relation to a substantially vertical axis passing through the center 32 of the cylindrical body 34 of the roll support 20 when the roll support 20 is mounted to the web material roll dispenser 200. It is understood that the first and second braking protrusions 52, 54 are laterally offset from the vertical central axis passing through the center 32 of the cylindrical body 34 of the roll support 20.

In other words, the roll support 20 has a lower half 36, the first and second braking protrusions 52, 54 protruding in the lower half 36 of the roll support 20, on a respective lateral side thereof.

The term "lower" should be understood with regard to the substantially horizontal axis X2, as represented in FIGS. 2A and 2B, passing through the center 32 of the cylindrical body 34 of the roll support 20 (for instance with regards to an axis substantially parallel to the longitudinal direction L1 when the roll support 20 is mounted to the roll support arm 90).

In the shown embodiment, as represented in FIG. 2B, first and second inclination angles $\alpha$, $\alpha'$ are defined between a substantially vertical axis X3 passing through the center 32 of the cylindrical body 34 (corresponding to a center of the roll-engaging portion 22 of the roll support 20) of the roll support 20 and an axis passing through the center 32 of the cylindrical body 34 of the roll support 20 and a distal end 53, 55 of each of the first and second braking protrusions 52, 54. In a non-limitative embodiment, the first and second inclination angles $\alpha$, $\alpha'$ are acute angles and are comprised between about 10° and about 80°. In another embodiment, the first and second inclination angles $\alpha$, $\alpha'$ are comprised between about 25° and about 65°. In yet another embodiment, the angles first and second inclination α, α' are comprised between about 35° and about 55°. Thus, each of the first and second braking protrusions 52, 54 are located on a respective side of the substantially vertical axis X3 passing through the center 32 of the roll-engaging portion 22 of the roll support 20.

The first and second braking protrusions 52, 54 are arranged so that, when an adequate pulling force is exerted on the web material 104, the first interior end 102 of the web material roll 100 is kept away from the first and second braking protrusions 52, 54 of the rotation brake 50. In other words, in the normal configuration of the web material roll 100 with respect to the roll support assembly 10 as represented for example on FIG. 2A, the first and second braking protrusions 52, 54 of the rotation brake 50 do not contact the inner surface of the first interior end 102. For instance, the web material roll 100 is configured in the normal configuration with respect to the roll support assembly 10 when stationary, i.e. non-rotating with respect to the roll support 20. In the normal configuration, the center 32 of the cylindrical body 34 of the roll support 20 is substantially horizontally aligned with a center 106 of the web material roll 100. In the normal configuration, the web material roll 100 is supported by and abuts the upper portion 25 of the peripheral wall 26 of the roll support 20. The roll 100 of web material is thus allowed to rotate freely, or only with low friction, relative to the roll support 20, to provide a portion of web material to the user.

By adequate pulling force, it should be understood a pulling force that is sufficient for the web material roll 100 to rotate relative to the roll support 20 and to deliver a portion of web material to the user as it is unwound.

When an excessive pulling force is exerted on the wound web material 104, the roll support assembly 10 takes an overspinning configuration, as represented for instance on FIG. 2B.

By excessive pulling force, it should be understood a pulling force that makes the web material roll 100 rotate relative to the roll support 20 at a rotation speed that is too high for the unwound web material to be fully delivered to the user by the material advancement or feed mechanism of the web material roll dispenser 200. Thus, due to the high rotation speed of the web material roll 100, the length of unwound web material would exceed the length of web material fed to the user by the material advancement or feed mechanism. In other words, the excessive pulling force would excessively unwind the web material 104, so that an amount of web material would accumulate in the web material roll dispenser 200 without being delivered to the user. In other words, again, the excessive pulling force would create an excessive overspinning of the web material roll 100.

A first threshold can thus be defined, so that when the rotation speed of the web material roll 100 relative to the roll support 20 exceeds the first threshold, the web material roll 100 with respect to the roll support assembly 10 will be configured in the overspinning configuration.

It should be understood that the first threshold does not correspond necessarily to a predetermined value and/or to fixed value, since the value of the first threshold would depend on different parameters, such as the weight of the web material roll 100, said weight depending for instance on the characteristics of the web material and on the number of layers formed by the roll of web material. The value of the first threshold thus varies among other things over the consumption level of the web material roll 100. The value of the first threshold would also depend on the materials delimiting the central passageway 110 of the web material roll 100 and the peripheral wall 26 of the roll support 20, said materials having an impact on the frictions that can be created between the two components.

In other words, the first threshold should not be considered as having a fixed value, but only represents a rotation speed on each side of which the assembly of the web material roll 100 and the roll support assembly 10 will have a different behavior. The web material roll 100 will be in the normal configuration with respect to the roll support assembly 10 when the rotation speed of the web material roll 100 relative to the roll support 20 is less than or equal to the first threshold. Otherwise, the web material roll 100 will be in the overspinning configuration with respect to the roll support assembly 10 when the rotation speed of the web material roll 100 relative to the roll support 20 exceeds the first threshold.

A high rotation speed of the web material roll 100 relative to the roll support 20 should thus be understood as a rotation speed that is greater than the value of the first threshold for the corresponding given state of the web material roll 100.

When the web material roll 100 is configured in the overspinning configuration with respect to the roll support assembly 10, the center 106 of the web material roll 100 is substantially horizontally (laterally) offset (from a length h1, as represented in FIG. 2B) with respect to the center 32 of the cylindrical body 34 of the roll support 20, as represented for instance on FIG. 2B. The horizontal offset h1 could thus be considered along the above-mentioned horizontal axis X2, or along a direction substantially parallel to the longitudinal direction L1 of the roll support arm 90 when the roll support 20 is mounted to the roll support arm 90. The horizontal offset h1 is also considered along a horizontal direction substantially perpendicular to the first axis X1 defined by the cylindrical body 34 of the roll support 20. Otherwise, in the normal configuration, the center 106 of the web material roll 100 is substantially aligned horizontally with respect to the center 32 of the cylindrical body 34 of the roll support 20, as shown in FIG. 2A. The web material roll 100 is thus displaced towards the dispensing opening 202 of the web material roll dispenser 200, as represented by arrow B on FIG. 2B, with respect to the roll support 20.

In the overspinning configuration of the roll support assembly 10, and due to the substantially horizontally offset of the center 106 of the web material roll 100 with respect to the center 32 of the cylindrical body 34 of the roll support 20, the inner surface of the web material roll 100 delimiting the central passageway 110 at the first interior end 102 frictionally engages one of the first and second braking protrusions 52, 54 of the rotation brake 50. Namely, as represented in FIG. 2A, the inner surface of the first interior end 102 frictionally engages the first braking protrusion 52 that is arranged at a rear portion of the rotation brake 50, i.e. towards the back-wall member 207 of the housing 204 and opposed to the cover 209 of the web material dispenser 200. It is appreciated that the inner surface of the central passageway 110 can be made of the web material itself or a central core (not shown) supporting the web material.

It should be understood that in the overspinning configuration of the roll support assembly 10, the web material roll 100 does not only frictionally engages the rotation brake 50 but further frictionally engages a rear portion of the peripheral outer surface 24 of the roll support 20 and, more particularly, the peripheral wall 26 of the cylindrical body 34. The term "rear" should be understood with regard to the substantially vertical axis X3, as represented in FIG. 2A, passing through the center 32 of the cylindrical body 34 of the roll support 20 (for instance with regards to an axis substantially perpendicular to the longitudinal direction L1 when the roll support 20 is mounted to the roll support arm 90). The rear portion of the peripheral outer surface 24 should thus be understood as the portion closer to the back-wall member 207 of the web material roll dispenser 200.

More particularly, as shown in FIG. 5, the rotation brake 50 is contained within the peripheral channel 28 defined in the roll support 20 and only the first and second braking protrusions 52, 54 of the rotation brake 50 protrude outwardly from the peripheral wall 26 and contact the inner surface of the web material roll 100 delimiting the central passageway 110 in the overspinning configuration. In other words, in the embodiment shown, the rotation brake 50 is substantially annular in shape and is at least partially inserted in the peripheral channel 28 defined in the roll-engaging portion 22 of the roll support 20. The peripheral channel 28 is deeper than a thickness of the rotation brake 50 so that only the first and second braking protrusions 52, 54 protrude outwardly from the peripheral wall 26.

The engagement of the inner surface of the first interior end 102 of the web material roll 100 with the rotation brake 50 decelerates the rotation of the web material roll 100 relative to the roll support 20 and, thereby, reduces the overspinning and the length of web material that accumulates in the interior chamber between the web material roll 100 and the material advancement or feed mechanism.

It should be understood that the term "brake" relative to the rotation brake 50 is used in the present application in the context of slowing down or deceleration of the rotation of the web material roll 100 relative to the roll support 20, and not only in the context of a complete immobilization of the web material roll 100 relative to the roll support 20.

It should also be noted that in some cases when the rotation speed of the web material roll 100 relative to the roll support 20 is particularly significant, the web material roll 100 can be horizontally displaced from a front end of the web material roll dispenser (for instance from the cover 209, in the embodiment shown) towards a rear end of the web material roll dispenser (for instance towards the back-wall member 207), so that the web material roll 100 can further frictionally engage a front portion of the rotation brake 50, and more particularly the second braking protrusion 54.

It is appreciated that the shape and the configuration of the rotation brake 50, as well as the shape, the number, the location and the configuration of the braking protrusions 52, 54 can vary from the embodiment shown.

In the first embodiment shown on FIGS. 1, 2A and 2B, the rotation brake 50 is configured to directly frictionally engage the web material roll 100, and more particularly to directly frictionally engage the inner surface of the web material roll 100 delimiting the central passageway 110.

FIGS. 3 to 9 represent a second embodiment of the roll support assembly 10.

Figure 3:
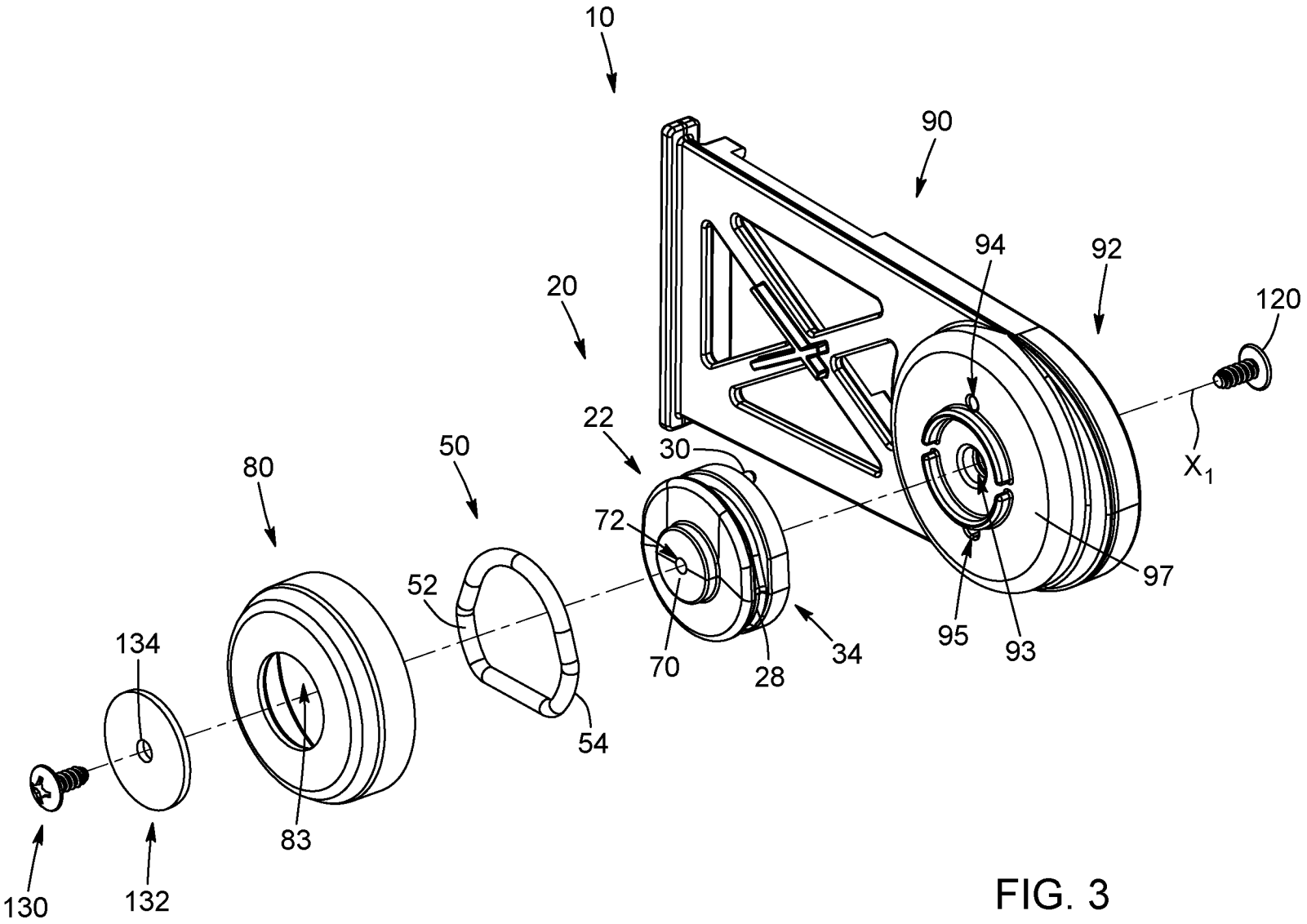
FIGS. 3 and 4 are respectively right and left side perspective views, exploded, of a second embodiment of a portion of the roll support assembly, the roll support assembly further comprising a spinning hub to be press-fitted into the roll of web material.
Figure 4:
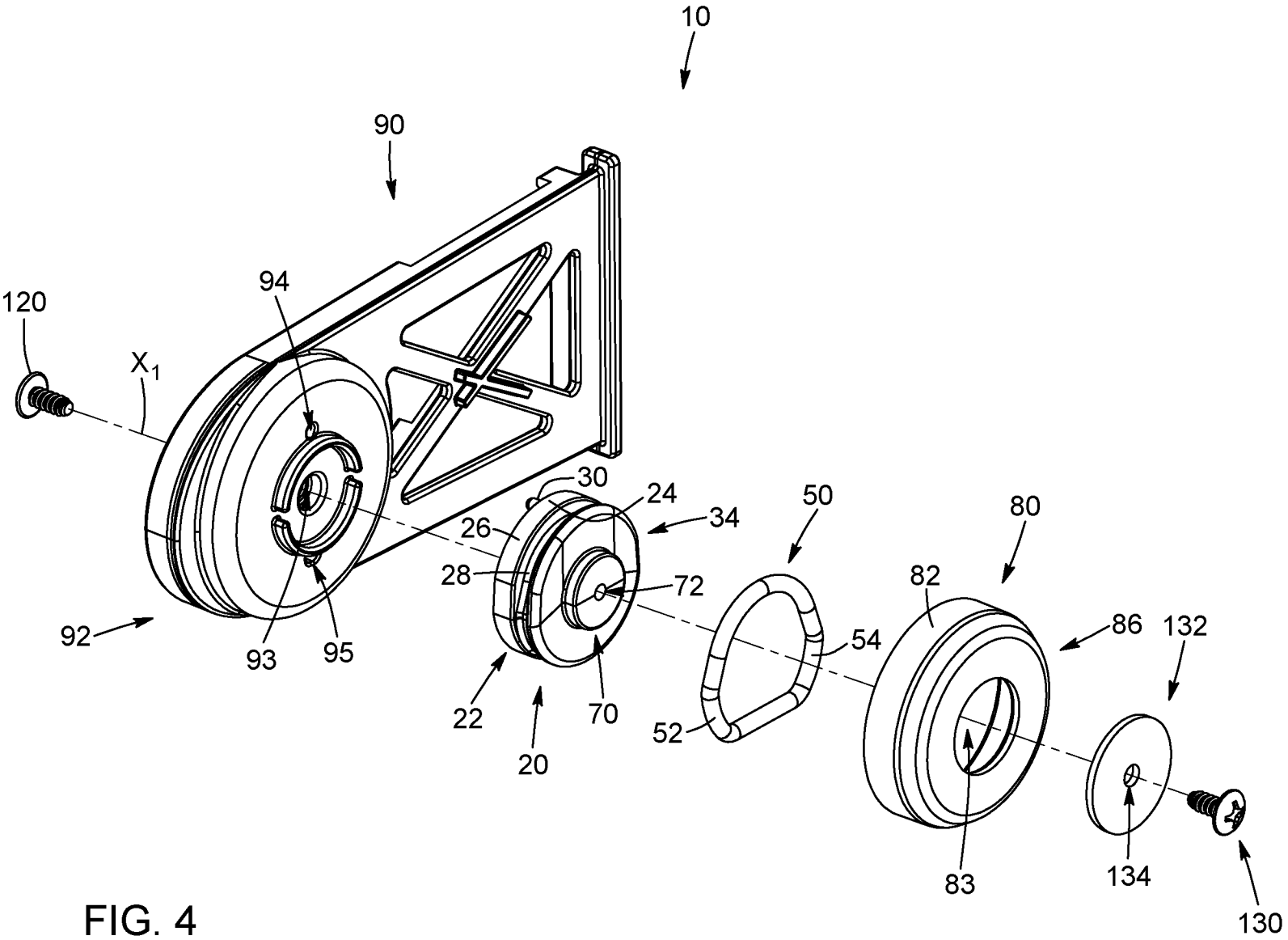
Figure 9:
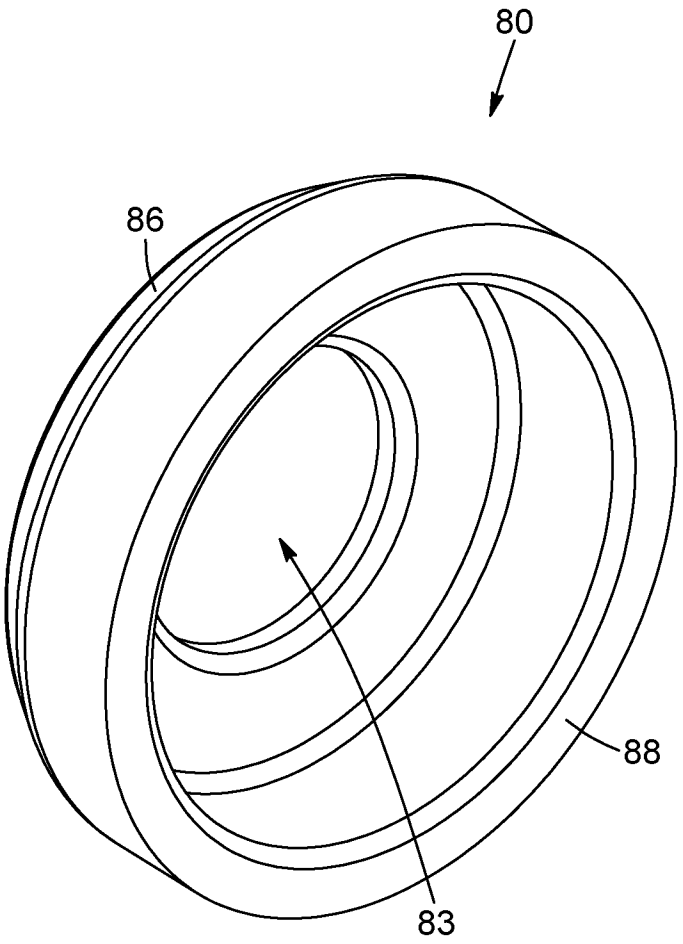
FIG. 9 is a rear perspective view of the spinning hub of the roll support assembly of FIGS. 3 and 4.

In the second embodiment, the roll support assembly 10 further comprises a spinning hub 80—represented in particular in FIGS. 3, 4 and 9—that is sized to be press-fitted into the first interior end 102 of the web material roll 100, i.e. inside the central passageway 110. The spinning hub 80 is configured to prevent or at least limit the deformation of the first side core end 102 of the web material roll 100, for instance during its transport or its installation in the web material roll dispenser 200. Such a deformation of the first interior end 102 could result in an impaired working of the web material roll dispenser 200, or in an impaired deceleration of the rotation of the web material roll 100 relative to the roll support 20. Thus, in some implementations, the spinning hub 80 can be supplied with the web material roll 100 and inserted in the housing of the web material roll dispenser 200 and engaged with the roll support(s) simultaneously therewith. In another embodiment, the spinning hub 80 can be inserted into the central passageway 110, at the first interior end 102, before inserting the web material roll 100 in the housing of the roll dispenser and engaging the web material roll 100 with the roll support(s).

Figure 6A:
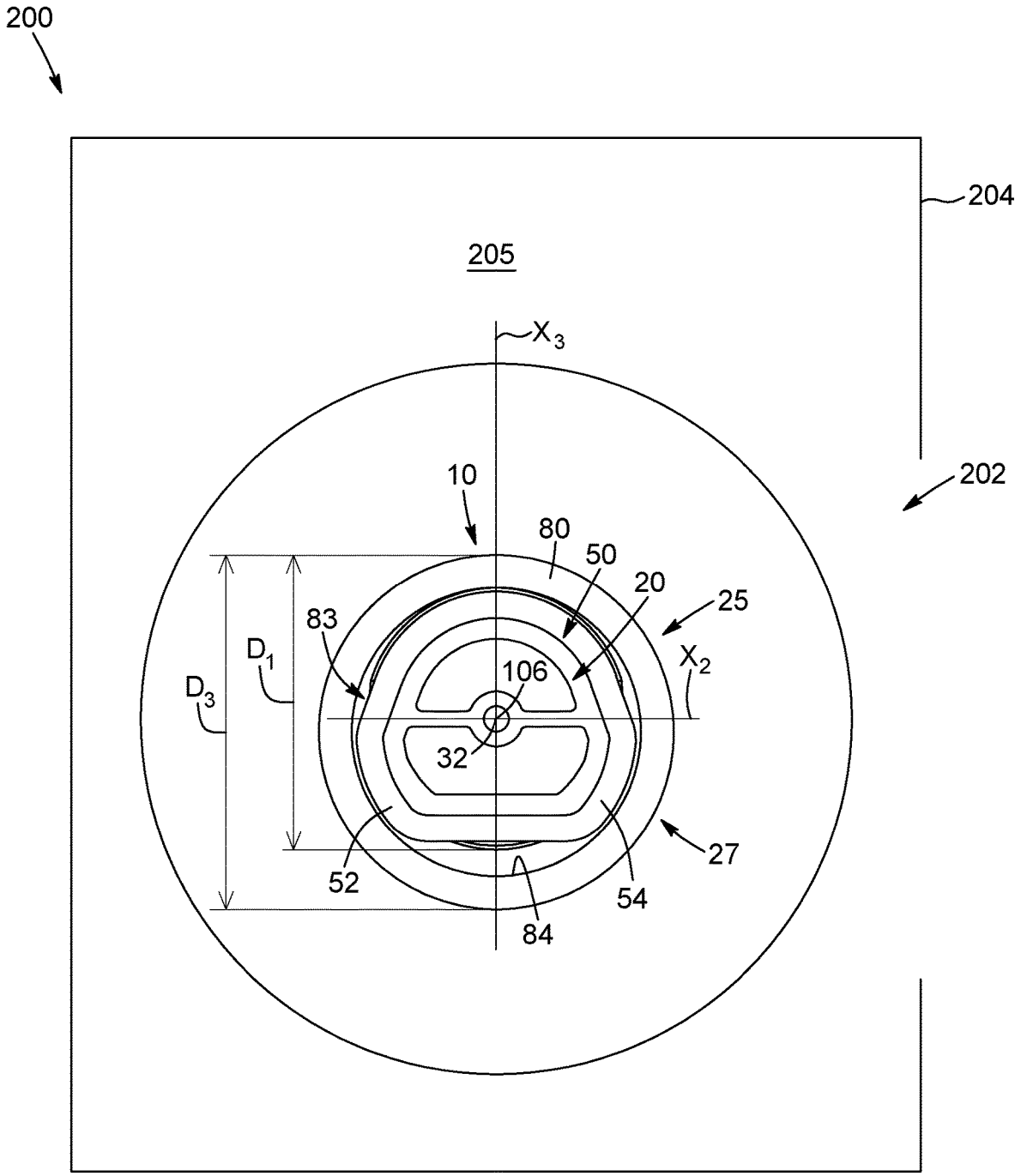
FIGS. 6A and 6B are cross sectional views along cross-section lines A-A of FIG. 5 of the portion of the roll support assembly of FIG. 5 engaged with the roll of web material, the roll of web material being supported in a housing of a web material roll dispenser, the roll support assembly being respectively configured in the normal configuration and in the overspinning configuration.
Figure 6B:
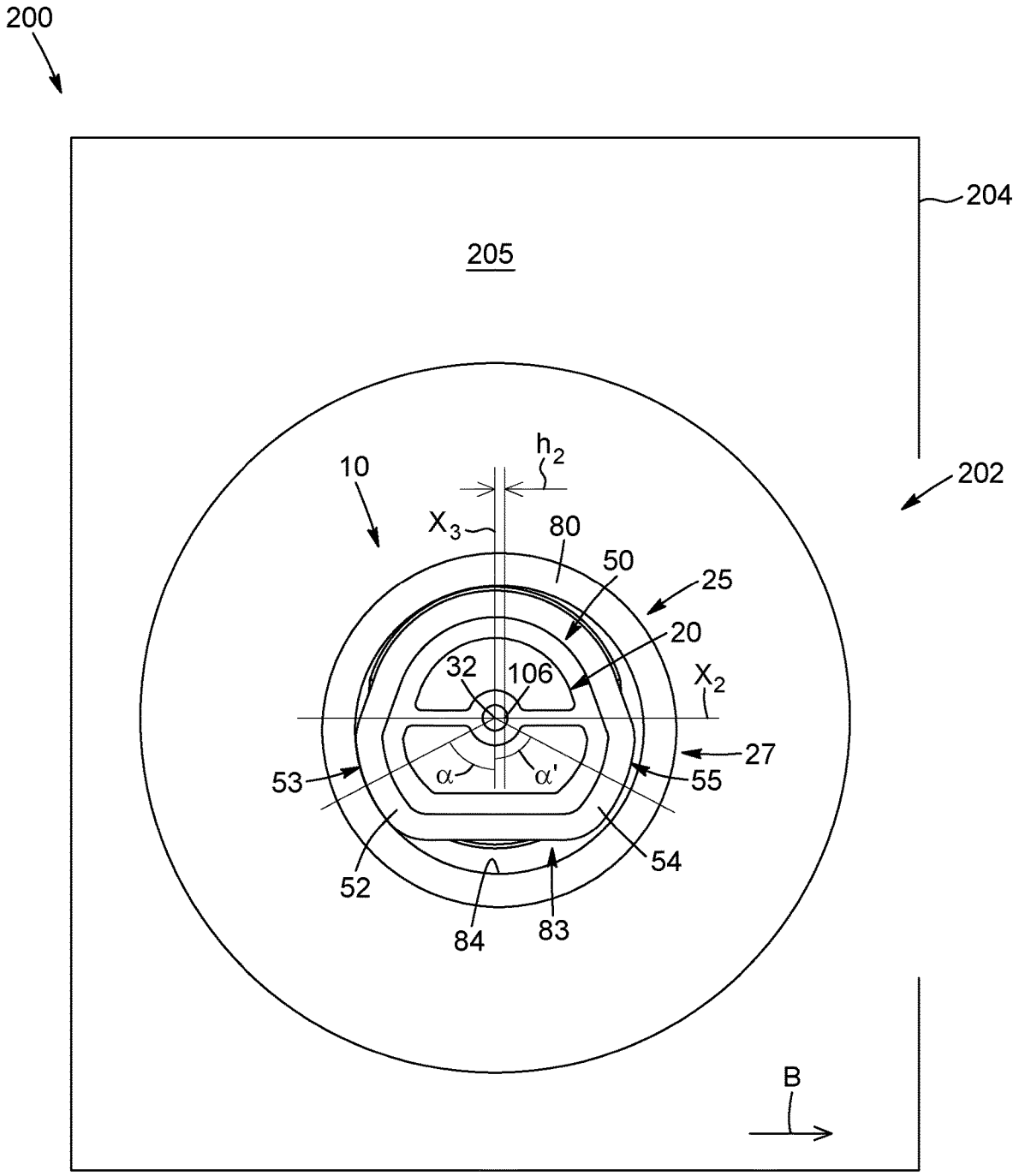
Figure 7:
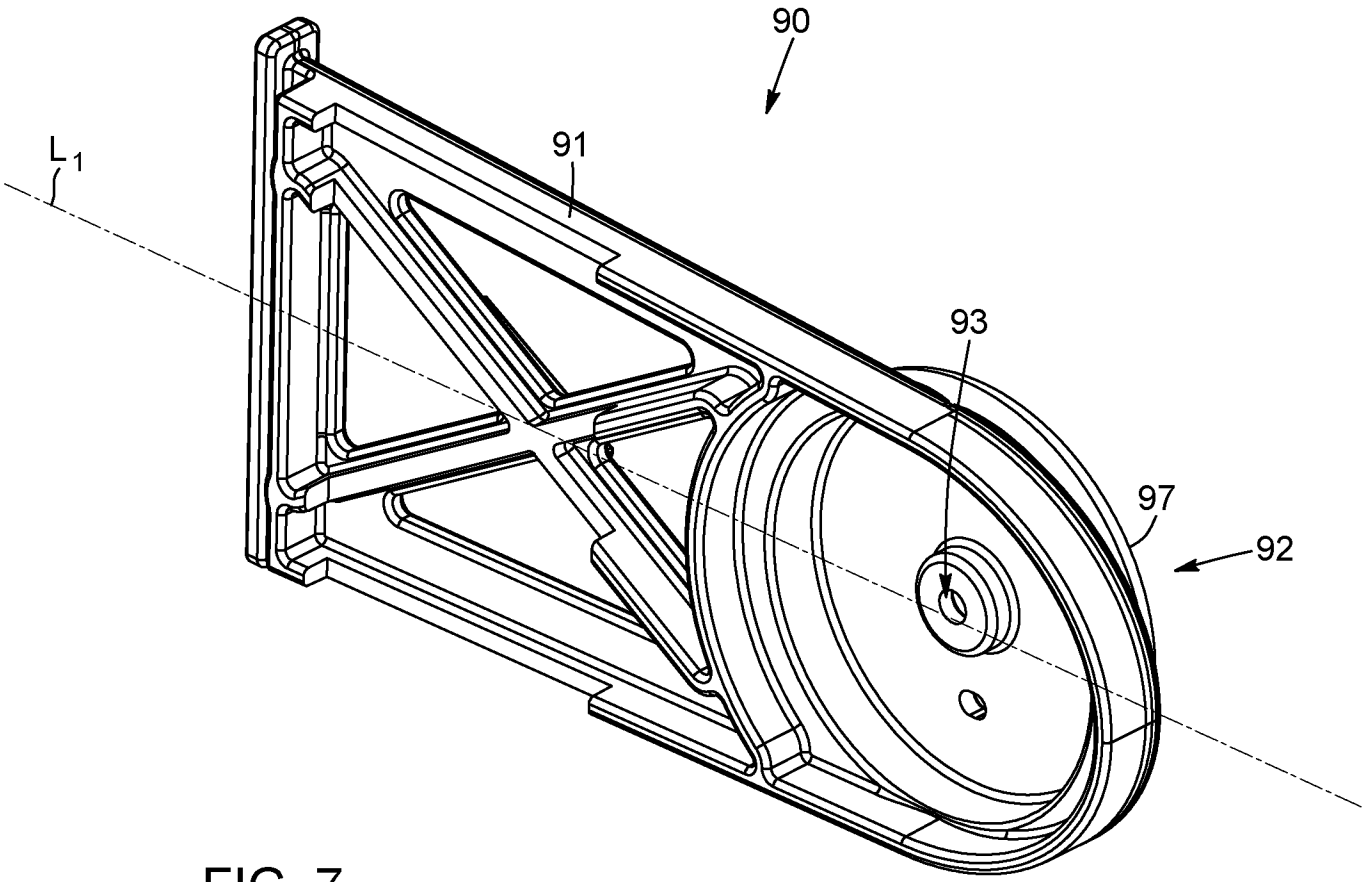
FIG. 7 is a rear perspective view of a roll support arm of the roll support assembly of FIGS. 3 and 4.

The spinning hub 80 has a cylindrical body 82 defining a roll support-engaging cavity 83 that is dimensioned to receive at least partially the roll-engaging portion 22 of the roll support 20 therein. The roll support-engaging cavity 83 has a third inner diameter D3, as represented in FIGS. 6A and 6B that is greater than the first diameter D1 of the roll-engaging portion 22 of the roll support 20. In other words, the roll-engaging portion 22 of the roll support 20 and the rotation brake 50 are insertable in the roll support-engaging cavity 83 of the spinning hub 80 without the first and second braking protrusions 52, 54 of the rotation brake 50 contacting an inner surface of the roll support-engaging cavity 83, when in the normal configuration. It is understood that the spinning hub 80 is frictionally inserted inside the central passageway 110 of the web material roll 100 to reduce and, if possible, substantially prevent relative rotation between the spinning hub 80 and the web material roll 100. Therefore, the web material roll 100 and the spinning hub 80 both rotate simultaneously and at substantially a same rotation speed relative to the roll support 20 when a pulling force is exerted on the web material 104. As represented in FIG. 5, in the embodiment shown, the spinning hub 80 has a substantially tapered distal end 86 (or roll-engaging end 86). In other words, the cross section of the spinning hub 80 decreases towards the roll-engaging end 86 opposed to a roll support-facing end 88.

It is appreciated that the shape and the configuration of the spinning hub 80 can vary from the embodiment shown.

As represented in FIGS. 3 to 5, the roll support 20 further comprises, in the embodiment shown, a connecting sleeve 70 protruding from the roll-engaging face 42 of the cylindrical body 34 (corresponding in the embodiment shown to a roll-engaging face of the roll-engaging portion 22) with a connecting aperture 72 formed in a center thereof and extending along the first axis X1. The roll support assembly 10 further comprises a mechanical fastener 130 (for instance but without being limitative a screw 130) engageable into the connecting aperture 72. In the embodiment shown, the roll support assembly 10 further comprises a stopper 132, in a shape of a substantially flat annular ring, engageable with the connecting sleeve 70 of the roll support 20. The stopper 132 has an opening 134 defined centrally therein, in which the fastener 130 can be at least partially inserted. When the stopper 132 is engaged with the connecting sleeve 70 of the roll support 20, the stopper 132 is spaced-apart from the roll-engaging face 42 of the roll support 20 so that a hub-receiving channel 136 is defined in between. The hub-receiving channel 136 extends axially (considered along the first axis X1) between the stopper 132 and the roll-engaging face 42 of the cylindrical body 34. The hub-receiving channel 136 is dimensioned and shaped to receive a distal wall portion 81 of the spinning hub 80. Thus, while the spinning hub 80 is rotatably mounted with regards to the roll support 20, the axial displacement of the spinning hub 80 (considered along the first axis X1) is limited within the hub-receiving channel 136 by the stopper 132 and the roll support 20, so as to limit the risk that the spinning hub 80

(and thus the web material roll 100) be accidentally disengaged from the roll support 20.

FIG. 6A represents the roll support assembly 10 in the normal configuration in which the web material roll 100 freely rotates—or with limited frictions—around the roll support 20 that is fixed to the roll dispenser via the roll support arm 90.

FIG. 6B represents the roll support assembly 10 in the overspinning configuration in which, due to an excessive rotation speed of the web material roll 100 relative to the roll support 20, the center 106 of the web material roll 100 is substantially horizontally offset of a length h2 considered along the axis X2 with respect to the center 32 of the cylindrical body 34 of the roll support 20.

In the overspinning configuration of the roll support assembly 10, an inner surface 84 of the cylindrical body 82, defining the roll support-engaging cavity 83, of the spinning hub 80 frictionally engages the rotation brake 50, and more particularly engages at least one of the first and second braking protrusions 52, 54 depending on the rotation speed of the web material roll 100 relative to the roll support 20. In other words, in the overspinning configuration, the first and second braking protrusions 52, 54 of the rotation brake 50 are engaged with an inner surface of the cylindrical body 82 of the spinning hub 80 to decelerate the rotation of the roll of web material 100 by frictional engagement therewith.

In the same way as the first embodiment of the roll support assembly 10 that has been described above, the frictional engagement of the spinning hub 80 with the rotation brake 50 decelerates the rotation of the web material roll 100 relative to the roll support 20.

In the second embodiment of the roll support assembly 10 shown on FIGS. 3, 4, 5, 6A and 6B, the rotation brake 50 is configured to indirectly frictionally engage the web material roll 100, via the spinning hub 80 that is mounted in the first interior end 102 of the web material roll 100.

In the first and second embodiments of the roll support assembly 10, the roll support 20 and the rotation brake 50 are two distinct components, the rotation brake 50 being fixedly secured to the peripheral outer surface 24 of the cylindrical body 34 of the roll support 20. The roll support 20 and the rotation brake 50 could however form a single integral component.

The number and the position of the braking protrusions 52, 54 of the rotation brake 50 are obviously not limited to the ones represented in the different figures and the rotation brake 50 could have a single braking protrusion or more than two braking protrusions. Furthermore, their angular position(s) can vary from the ones shown in the accompanying figures.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

What is claimed is:

1. A roll support assembly for a web material dispenser configured to contain a roll of web material having a first interior end, the roll support assembly comprising:

a roll support mountable into the web material dispenser and including a roll-engaging portion with a peripheral wall engageable into the first interior end of the roll of web material with the roll of web material being rotatable relative to the roll support when engaged therewith and when a pulling force is exerted on the web material; and a rotation brake comprising at least one braking protrusion protruding outwardly from the peripheral wall of the roll-engaging portion and decelerating automatically the rotation of the roll of web material by frictionally engaging at least one of directly and indirectly the roll of web material when a rotation speed of the roll of web material relative to the roll-engaging portion of the roll support exceeds or is equal to a first threshold:

wherein the roll of web material is free from any engagement with said at least one braking protrusion when the rotation speed of the roll of web material relative to the roll-engaging portion of the roll support is less than said first threshold.

2. The roll support assembly according to claim 1, wherein the roll support comprises a cylindrical body defining at least partially the roll-engaging portion and including the peripheral wall.

3. The roll support assembly according to claim 1, wherein the peripheral wall of the roll-engaging portion comprises a peripheral channel defined therein with the rotation brake being annular in shape and being at least partially inserted in the peripheral channel.

4. The roll support assembly according to claim 3, wherein the peripheral channel is deeper than a thickness of the rotation brake and only the at least one braking protrusion protrudes outwardly from the peripheral wall.

5. The roll support assembly according to claim 1, wherein the rotation brake is fixedly secured to the peripheral wall of the roll-engaging portion.

6. The roll support assembly according to claim 1, wherein the roll-engaging portion of the roll support and the rotation brake form a single integral component.

7. The roll support assembly according to claim 1, wherein the roll-engaging portion of the roll support and the rotation brake are insertable in the first interior end of the roll of web material without the at least one braking protrusion of the rotation brake contacting an inner surface of the first interior end of the roll of web material.

8. The roll support assembly according to claim 1, wherein the roll-engaging portion of the roll support has an upper portion and a lower portion with said at least one braking protrusion of the rotation brake protruding from the lower portion.

9. The roll support assembly according to claim 1, wherein the roll-engaging portion of the roll support comprises a center and a first acute inclination angle is defined between a substantially vertical axis passing through the center of the roll-engaging portion of the roll support when the roll support is contained into the web material dispenser, and an axis passing through the center of the roll-engaging portion of the roll support and a distal end of said at least one braking protrusion.

10. The roll support assembly according to claim 9, wherein the rotation brake comprises at least two braking protrusions, each of the at least two braking protrusions being located on a respective side of the substantially vertical axis passing through the center of the roll-engaging portion of the roll support.

11. The roll support assembly according to claim 1, further comprising a spinning hub sized to be press-fitted into the first interior end of the roll of web material and having a cylindrical body defining a roll support-engaging cavity, the roll-engaging portion of the roll support being at least partially insertable into the roll support-engaging cavity so that the at least one braking protrusion of the rotation brake is engageable with an inner surface of the cylindrical body of the spinning hub to decelerate the rotation of the roll of web material by frictional engagement therewith.

12. The roll support assembly according to claim 11, wherein the roll support further comprises a connecting sleeve protruding from a roll-engaging face of the roll-engaging portion, the roll support assembly further comprising a stopper engageable with the connecting sleeve so as to form a hub-receiving channel therebetween with the spinning hub being at least partially received in the hub-receiving channel.

13. A web material dispenser comprising:

a housing; and the roll support assembly according to claim 1 located within the housing and mounted thereto.

14. A roll support assembly for a web material dispenser having a dispensing opening and configured to contain a roll of web material having a first interior end and dispense the web material through the dispensing opening, the roll support assembly comprising a roll support mountable into the web material dispenser and having a substantially cylindrical body with a peripheral wall and a roll-engaging portion engageable with the first interior end of the roll of web material with the roll of web material being rotatable relative to the roll support when engaged with the roll-engaging portion and when a pulling force is exerted on the web material, the roll of web material being configurable in a normal configuration and an overspinning configuration with respect to the roll-engaging portion of the roll support wherein, in the overspinning configuration, the roll of web material is displaced towards the dispensing opening due to a high rotation speed of the roll of web material relative to the roll-engaging portion of the roll support; and at least one braking protrusion protruding outwardly from the peripheral wall of the cylindrical body in the roll-engaging portion, the at least one braking protrusion being spaced-apart from the roll of web material in the normal configuration and the roll of web material frictionally engaging the at least one braking protrusion in the overspinning configuration.

15. The roll support assembly according to claim 14, wherein the roll of web material frictionally engages the at least one braking protrusion when the rotation speed of the roll of web material relative to the roll-engaging portion of the roll support exceeds or is equal to a first threshold and wherein the roll of web material is free from any engagement with said at least one braking protrusion when the rotation speed of the roll of web material relative to the roll-engaging portion of the roll support is less than said first threshold.

16. The roll support assembly according to claim 14, wherein in the overspinning configuration, a center of the roll of web material is substantially horizontally offset with respect to a center of the roll-engaging portion of the roll support due to an excessive pulling force exerted on the web material.

17. The roll support assembly according to claim 14, wherein the roll support assembly further comprises a rotation brake connected to the roll-engaging portion of the roll support and including the at least one braking protrusion protruding outwardly from the peripheral wall of the cylindrical body.

18. The roll support assembly according to claim 17, wherein the peripheral wall of the cylindrical body comprises a peripheral channel defined therein with the rotation brake being annular in shape and at least partially inserted in the peripheral channel.

19. The roll support assembly according to claim 18, wherein the peripheral channel is deeper than a thickness of the rotation brake and only the at least one braking protrusion protrudes outwardly from the peripheral wall.

20. The roll support assembly according to claim 17, wherein the rotation brake is fixedly secured to the peripheral wall of the cylindrical body.

21. The roll support assembly according to claim 14, wherein the cylindrical body of the roll support has an upper portion and a lower portion with said at least one braking protrusion protruding from the lower portion.

22. The roll support assembly according to claim 14, wherein the cylindrical body comprises a center and a first acute inclination angle is defined between a substantially vertical axis passing through the center of the cylindrical body when the roll support is mounted to the web material dispenser, and an axis passing through the center of the cylindrical body and a distal end of said at least one braking protrusion.

23. The roll support assembly according to claim 22, wherein the roll support assembly comprises at least two braking protrusions, each of the at least two braking protrusions being located on a respective side of the substantially vertical axis passing through the center of the cylindrical body.

24. The roll support assembly according to claim 14, further comprising a roll support arm mountable to the web material dispenser, the cylindrical body being located at a free end of the roll support arm.

25. The roll support assembly according to claim 24, wherein the cylindrical body and the roll support arm further comprise complementary male-female members engageable together to prevent rotation of the cylindrical body relative to the roll support arm when engaged together.

26. The roll support assembly according to claim 14, further comprising a spinning hub sized to be press-fitted into the first interior end of the roll of web material and having a cylindrical body defining a roll support-engaging cavity, the cylindrical body of the roll support being at least partially insertable into the roll support-engaging cavity so that the at least one braking protrusion is engageable with an inner surface of the cylindrical body of the spinning hub to decelerate the rotation of the roll of web material by frictional engagement therewith.

27. The roll support assembly according to claim 26, wherein the cylindrical body of the roll support and the at least one braking protrusion are insertable in the roll support-engaging cavity of the spinning hub without the at least one braking protrusion contacting an inner surface of the roll support-engaging cavity in the normal configuration.

28. The roll support assembly according to claim 26, wherein the roll support further comprises a connecting sleeve protruding from a roll-engaging face of the cylindrical body, the roll support assembly further comprising a stopper engageable with the connecting sleeve so as to form a hub-receiving channel therebetween with the spinning hub being at least partially received in the hub-receiving channel.

29. A web material dispenser comprising:

a housing; and the roll support assembly according to claim 14 located within the housing and mounted thereto.

30. A web material dispenser configured to support a roll of web material having a first interior end, the web material dispenser comprising:

a housing defining a dispensing opening; and a roll support assembly located within the housing and configured to rotatably receive and support the roll of web material, the roll support assembly including:

a roll support mounted to the housing and including a substantially cylindrical body having a peripheral wall, a lower half and a vertical central axis, the cylindrical body being engageable with the first interior end of the roll of web material with the roll of web material being rotatable relative to the cylindrical body when engaged therewith; and at least one braking protrusion protruding from the peripheral wall of the cylindrical body in the lower half thereof, offset from the vertical central axis of the cylindrical body, wherein the roll of web material frictionally engages the at least one braking protrusion when a center of the roll of web material is substantially horizontally offset with respect to a center of the roll support due to an excessive pulling force exerted on the web material and disengaged from the at least one braking protrusion otherwise.

31. The web material dispenser according to claim 30, wherein the roll of web material frictionally engages the at least one braking protrusion when a rotation speed of the roll of web material relative to the cylindrical body exceeds or is equal to a first threshold and wherein the roll of web material is disengaged from said at least one braking protrusion when the rotation speed of the roll of web material relative to the cylindrical body is less than said first threshold.

32. The web material dispenser according to claim 30, wherein the roll support assembly further comprises a rotation brake connected to the cylindrical body and including the at least one braking protrusion protruding outwardly from the peripheral wall of the cylindrical body.

33. The web material dispenser according to claim 32, wherein the peripheral wall of the cylindrical body comprises a peripheral channel defined therein with the rotation brake being substantially annular in shape and being at least partially inserted in the peripheral channel.

34. The web material dispenser according to claim 33, wherein the peripheral channel is deeper than a thickness of the rotation brake and only the at least one braking protrusion protrudes outwardly from the peripheral wall.

35. The web material dispenser according to claim 32, wherein the rotation brake is fixedly secured to the peripheral wall of the cylindrical body.

36. The web material dispenser according to claim 30, wherein a first acute inclination angle is defined between the vertical central axis of the cylindrical body and an axis passing through a center of the cylindrical body and a distal end of said at least one braking protrusion.

37. The web material dispenser according to claim 30, wherein the roll support assembly comprises at least two braking protrusions, each of the at least two braking protrusions being located on a respective side of the vertical central axis of the cylindrical body.

38. The web material dispenser according to claim 30, further comprising a spinning hub sized to be press-fitted into the first interior end of the roll of web material and having a cylindrical body defining a roll support-engaging cavity, the cylindrical body of the roll support being at least partially insertable into the roll support-engaging cavity so that the at least one braking protrusion is engageable with an inner surface of the cylindrical body of the spinning hub to decelerate the rotation of the roll of web material by frictional engagement therewith.

39. A roll support assembly for a web material dispenser configured to contain a roll of web material having a first interior end, the roll support assembly comprising:

a roll support mountable into the web material dispenser and including a roll-engaging portion with a peripheral wall engageable into the first interior end of the roll of web material with the roll of web material being rotatable relative to the roll support when engaged therewith and when a pulling force is exerted on the web material, the peripheral wall of the roll-engaging portion comprising a peripheral channel defined therein; and a rotation brake being annular in shape and comprising at least one braking protrusion protruding outwardly from the peripheral wall of the roll-engaging portion and decelerating the rotation of the roll of web material by frictionally engaging at least one of directly and indirectly the roll of web material, the rotation brake being at least partially inserted in the peripheral channel;

wherein the peripheral channel of the peripheral wall is deeper than a thickness of the rotation brake and only the at least one braking protrusion protrudes outwardly from the peripheral wall.

* * * * *